US009431768B1

(12) United States Patent
Champion et al.

(10) Patent No.: US 9,431,768 B1
(45) Date of Patent: Aug. 30, 2016

(54) ELECTRICAL CONNECTOR HAVING RESONANCE CONTROL

(71) Applicant: Tyco Electronics Corporation, Berwyn, PA (US)

(72) Inventors: Bruce Allen Champion, Camp Hill, PA (US); Chad William Morgan, Carneys Point, NJ (US); John Joseph Consoli, Harrisburg, PA (US); Thomas de Boer, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/671,442

(22) Filed: Mar. 27, 2015

(51) Int. Cl.

| | |
|---|---|
| ***H01R 13/64*** | (2006.01) |
| ***H01R 13/6471*** | (2011.01) |
| ***H01R 13/6585*** | (2011.01) |
| ***H01R 13/66*** | (2006.01) |

(52) U.S. Cl.
CPC ..... *H01R 13/6471* (2013.01); *H01R 13/6585* (2013.01); *H01R 13/665* (2013.01)

(58) Field of Classification Search
CPC ..... H01R 13/6464; H01R 13/6471
See application file for complete search history.

(56) References Cited

U.S. PATENT DOCUMENTS

| | | | | |
|---|---|---|---|---|
| 7,371,117 | B2 | 5/2008 | Gailus | |
| 8,177,564 | B1 | 5/2012 | Ito et al. | |
| 8,523,583 | B2 | 9/2013 | Ito | |
| 8,764,464 | B2 | 7/2014 | Buck et al. | |
| 9,028,281 | B2 * | 5/2015 | Kirk | H01R 12/724 439/701 |
| 2014/0127946 | A1 | 5/2014 | Ito et al. | |

* cited by examiner

*Primary Examiner* — Ross Gushi

(57) ABSTRACT

Electrical connector includes a connector housing having a front side configured to mate with a mating connector and a mounting side configured to be mounted to a circuit board. The electrical connector also includes signal and ground conductors that extend through the connector housing between the front and mounting sides. The signal conductors form a plurality of signal pairs. The ground conductors are positioned relative to the signal pairs to form a plurality of ground-signal-signal-ground (GSSG) sub-arrays. Each GSSG sub-array includes a corresponding signal pair and first and second ground conductors that separate the corresponding signal pair from adjacent signal pairs. The electrical connector also includes a plurality of resonance-control bridges in which each resonance-control bridge electrically couples the first and second ground conductors of a corresponding GSSG sub-array. Each of the resonance-control bridges includes at least one of a capacitor or a resistor.

20 Claims, 9 Drawing Sheets

ELECTRICAL CONNECTOR HAVING RESONANCE CONTROL

BACKGROUND

The subject matter herein relates generally to electrical connectors that have pairs of signal conductors configured to convey differential signals and ground conductors that control impedance and reduce crosstalk between the pairs of signal conductors as well as to provide a reliable ground return path.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors are arranged in signal pairs for carrying differential signals. The ground conductors are positioned between the signal pairs to control impedance and reduce crosstalk. Each signal pair may be separated from the adjacent signal pairs by one or more ground conductors. For example, the signal and ground conductors may be arranged in a ground-signal-signal-ground (GSSG) pattern.

There has been a general demand to increase the density of signal conductors within the electrical connectors and/or increase the speeds at which data is transmitted through the electrical connectors. As data rates increase and/or distances between the signal pairs decrease, however, it becomes more challenging to maintain a baseline level of signal quality. More specifically, in some cases, electrical energy that flows along the surface of each ground conductor may form a field that propagates between the ground conductors. For example, the ground conductors that flank the signal pair in the GSSG pattern may couple with each other to support an unwanted propagating signal mode. The unwanted electrical propagation mode may then be repeatedly reflected, such as between two PCB ground planes, and form a resonating condition (or standing wave) that causes electrical noise. Depending on the frequency of the data transmission, the electrical noise may increase return loss and/or crosstalk and reduces throughput of the electrical connector.

To control resonance between ground conductors and limit the effects of the resulting electrical noise, it has been proposed to electrically common the separate ground conductors using a metal conductor or a lossy plastic material. The effectiveness and/or cost of implementing these techniques is based on a number of variables, such as the geometry of the connector housing and geometries of the signal and ground conductors within the electrical connector. For some applications and/or electrical connector configurations, alternative methods for controlling resonance between the ground conductors may be desired.

Accordingly, there is a need for electrical connectors that reduce the electrical noise caused by resonating conditions in ground conductors.

BRIEF DESCRIPTION

In an embodiment, an electrical connector is provided that includes a connector housing having a front side configured to mate with a mating connector and a mounting side configured to be mounted to a circuit board. The electrical connector also includes signal and ground conductors that extend through the connector housing. The signal conductors form a plurality of signal pairs configured to carry differential signals. The ground conductors are positioned relative to the signal pairs to form a plurality of ground-signal-signal-ground (GSSG) sub-arrays. Each GSSG sub-array includes a corresponding signal pair and first and second ground conductors that separate the corresponding signal pair from adjacent signal pairs. The electrical connector also includes a plurality of resonance-control bridges in which each resonance-control bridge electrically couples the first and second ground conductors of a corresponding GSSG sub-array. Each of the resonance-control bridges includes at least one of a capacitor or a resistor.

In some embodiments, the plurality of GSSG sub-arrays includes a first GSSG sub-array and a second GSSG sub-array. The first and second GSSG sub-arrays may have a shared ground conductor that is the second ground conductor of the first GSSG sub-array and the first ground conductor of the second GSSG sub-array. The shared ground conductor may be coupled to two of the resonance-control bridges. Optionally, the two resonance-control bridges are coupled to the shared ground conductor through a shared interconnecting element. The shared interconnecting element may include a base portion that couples to the shared ground conductor and first and second fingers. The first and second fingers are shaped to extend away from each other. Alternatively, the two resonance-control bridges have a respective interconnecting element that is separately coupled to the shared ground conductor.

In some embodiments, the first and second ground conductors of each GSSG sub-array are electrically coupled to first and second conductive surfaces, respectively, that are exposed along an exterior of the connector housing. Each resonance-control bridge may include a discrete component that is electrically coupled to the first and second conductive surfaces of the corresponding GSSG sub-array.

In some embodiments, the connector housing includes a housing side that faces an exterior of the connector housing. The resonance-control bridges may be positioned along the housing side such that the resonance-control bridges are accessible from the exterior of the connector housing.

In some embodiments, the connector housing includes a housing side and the signal and ground conductors form a first conductor row and a second conductor row. The resonance-control bridges are coupled to the first and second ground conductors of the first conductor row through the housing side. The resonance-control bridges are coupled to the first and second ground conductors of the second conductor row through the mounting side.

In an embodiment, a circuit board assembly is provided that includes a circuit board having a board surface. The circuit board assembly includes an electrical connector configured to engage a mating connector during a mating operation. The electrical connector includes a connector housing having a front side configured to engage the mating connector and a mounting side mounted to the board surface of the circuit board. The electrical connector also includes signal and ground conductors that extend through the connector housing. The signal conductors form a plurality of signal pairs configured to carry differential signals. The ground conductors are positioned relative to the signal pairs to form a plurality of ground-signal-signal-ground (GSSG) sub-arrays. Each GSSG sub-array includes a corresponding signal pair and first and second ground conductors that separate the corresponding signal pair from adjacent signal pairs. The electrical connector also includes a plurality of resonance-control bridges in which each resonance-control bridge electrically couples the first and second ground conductors of a corresponding GSSG sub-array. Each of the resonance-control bridges includes at least one of a capacitor or a resistor.

DETAILED DESCRIPTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a receptacle connector that is mounted to and electrically coupled to a circuit board. The receptacle connector is configured to mate with a pluggable input/output (I/O) connector during a mating operation. It should be understood, however, that the inventive subject matter set forth herein may be applicable in other types of electrical connectors. Moreover, in various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps.

The electrical connectors include signal and ground conductors that are positioned relative to each other to form a pattern or array that includes one or more rows (or columns). The signal and ground conductors of a single row (or column) may be substantially co-planar. The signal conductors form signal pairs in which each signal pair is flanked on both sides by ground conductors. The ground conductors electrically separate the signal pairs to reduce electromagnetic interference or crosstalk and to provide a reliable ground return path. The signal and ground conductors in a single row are patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors.

Figure 1:
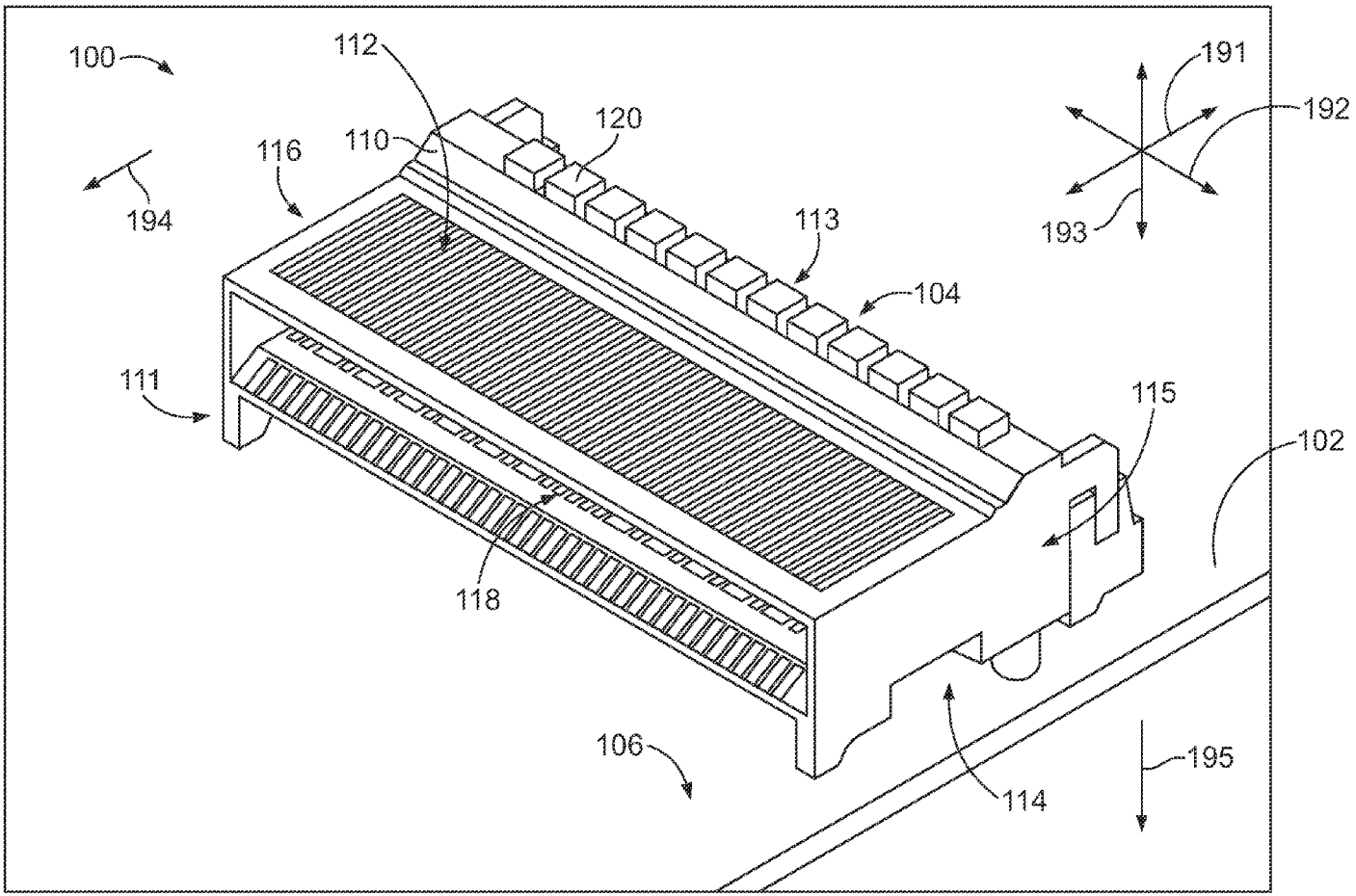
FIG. 1 is a perspective view of a circuit board assembly formed in accordance with an embodiment.

FIG. 1 is a perspective view of a portion of a circuit board assembly 100 formed in accordance with an embodiment. The circuit board assembly 100 includes a circuit board 102 and an electrical connector 104 that is mounted onto a board surface 106 of the circuit board 102. The circuit board assembly 100 is oriented with respect to mutually perpendicular axes, including a mating axis 191, a lateral axis 192, and a vertical or elevation axis 193. In FIG. 1, the vertical axis 193 extends parallel to a gravitational force direction. It should be understood, however, that embodiments described herein are not limited to having a particular orientation with respect to gravity. For example, the lateral axis 192 may extend parallel to the gravitational force direction in other embodiments.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) connector. The electrical connectors 104 and pluggable I/O connectors may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 104 described herein may be high-speed electrical connectors that are capable of transmitting data at a rate of at least about five (5) gigabits per second (Gbps), at least about 10 Gbps, at least about 20 Gbps, at least about 40 Gbps, or more.

Although not shown, each of the electrical connectors 104 may be positioned within a receptacle cage. The receptacle cage may be configured to receive one of the pluggable I/O connectors during a mating operation and direct the pluggable I/O connector toward the corresponding electrical connector 104. The circuit board assembly 100 may also include other devices that are communicatively coupled to the electrical connectors 104 through the circuit board 102. The electrical connectors 104 may be positioned proximate to one edge of the circuit board.

The electrical connector 104 includes a connector housing 110 having a plurality of housing sides 111-116. The housing sides 111-116 include a front side 111, a top side 112, a back side 113, and a mounting side 114. The housing sides 115, 116 extend between the back side 113 and the front side 111. The front side 111 and the back side 113 face in opposite directions along the mating axis 191, and the top side 112 and the mounting side 114 face in opposite directions along the vertical axis 193. The top side 112 faces away from the circuit board 102 and may have the greatest elevation of the housing sides 111-116 with respect to the board surface 106. The front side 111 is configured to mate with a mating connector (not shown), such as the mating connector 266 shown in FIG. 7, and the mounting side 114 is configured to be mounted to the board surface 106.

In the illustrated embodiment of FIG. 1, the electrical connector 104 is a right-angle connector such that the front side 111 and the mounting side 114 are oriented substantially perpendicular or orthogonal to each other. More specifically, the front side 111 faces in a receiving direction 194 along the mating axis 191, and the mounting side 114 faces in a mounting direction 195 along the vertical axis 193. In other embodiments, the front side 111 and the mounting side 114 may face in different directions than those shown in FIG. 1. For example, the front side 111 and the mounting side 114 may face in opposite directions.

The connector housing 110 includes a receiving cavity 118 that is sized and shaped to receive a portion of the mating connector. For example, in the illustrated embodiment, the receiving cavity 118 is sized and shaped to receive a circuit board (not shown) of the mating connector. The circuit board of the mating connector may include one or more rows of contact pads located along a leading edge of the circuit board.

The electrical connector 104 includes signal conductors and ground conductors (not shown) that extend through the connector housing 110 between the front side 111 and the mounting side 114. Each of the signal and ground conductors may extend between a mating interface and a terminating end. The mating interfaces are configured to slidably engage corresponding contact pads of the mating connector, and the terminating ends are configured to engage the circuit board 102. For example, the terminating ends may be soldered or welded to traces or contact pads (not shown) along the board surface 106. Alternatively, the terminating ends may form compliant pins that are inserted into plated thru-holes (PTHs) (not shown) of the circuit board 102.

The signal and ground conductors may be similar or identical to signal and ground conductors 170, 172 or the signal and ground conductors 174, 176, which are described below with reference to FIGS. 2-7. In particular, the signal and ground conductors may be arranged to form a plurality of ground-signal-signal-ground (GSSG) sub-arrays in which each pair of signal conductors is located between two conductors. The electrical connector 104 may also include a plurality of resonance-control bridges 120. Each of the resonance-control bridges 120 is configured to electrically couple the two ground conductors that are located on opposite sides of a signal pair of a corresponding GSSG sub-array. The resonance-control bridges 120 may control or limit undesirable resonances that occur within the ground conductors during operation of the electrical connector 104. Each of the resonance-control bridges 120 may include at least one of a capacitor or a resistor. In particular embodiments, the resonance-control bridges 120 are discrete components that are electrically coupled to the ground conductors. As described herein, the resonance-control bridges 120 may effectively reduce the frequency of energy resonating within the ground conductors.

In the illustrated embodiment, the resonance-control bridges 120 are distributed laterally along the top side 112. The resonance-control bridges 120 may also be positioned laterally along the mounting side 114. In other embodiments, the resonance-control bridges 120 may be positioned laterally along the back side 113. In the illustrated embodiment, the resonance-control bridges 120 may have a common axial location relative to the mating axis 191. In other embodiments, however, the resonance-control bridges 120 may have different axial locations. For example, some of the resonance-control bridges 120 may be located closer to the back side 113 than other resonance-control bridges 120.

Figure 2:
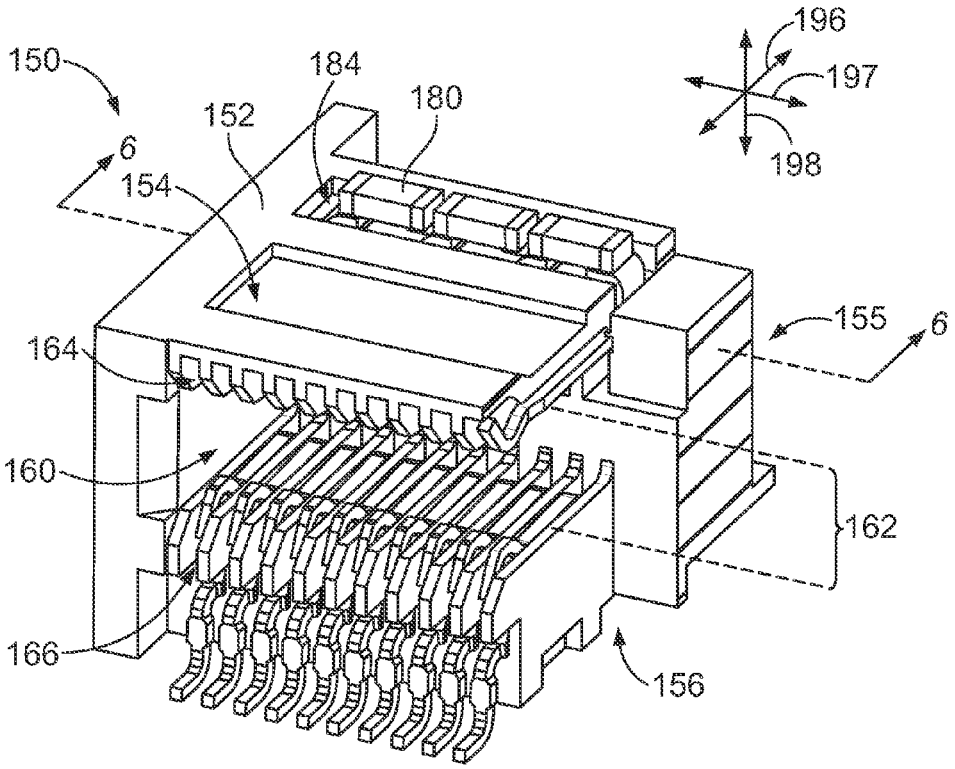
FIG. 2 is a top perspective cutaway view of an electrical connector formed in accordance with an embodiment.
Figure 3:
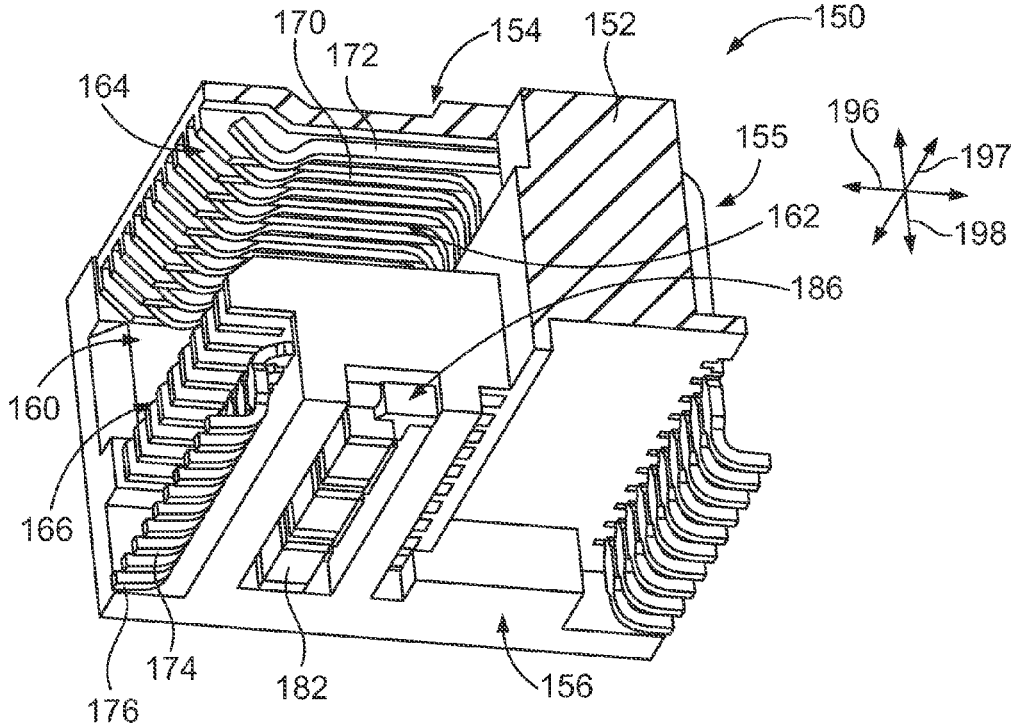
FIG. 3 is another perspective cutaway view of the electrical connector of FIG. 2.

FIG. 2 illustrates a top perspective cutaway view of an electrical connector 150 formed in accordance with an embodiment, and FIG. 3 is another perspective cutaway view through a different section of the electrical connector 150. The electrical connector 150 may be similar to the electrical connector 104 (FIG. 1) and may replace the electrical connector 104 in the circuit board assembly 100 (FIG. 1). In FIGS. 2 and 3, the electrical connector 150 is oriented with respect to mutually perpendicular axes 196-198, including a mating axis 196, a lateral axis 197, and a vertical or mounting axis 198.

The electrical connector 150 has a connector housing 152, which may be similar to the connector housing 110 (FIG. 1). For example, the connector housing 152 includes a front side 153 (shown in FIG. 7), a top side 154, a back side 155, and a mounting side 156. The top side 154 and the mounting side 156 face in opposite directions along the vertical axis 198. The mounting side 156 is configured to interface with a board surface 267 (shown in FIG. 7) of a circuit board 265 (shown in FIG. 7). The front side 153 faces along the mating axis 196 and is configured to engage a mating connector 264 (shown in FIG. 7), such as a pluggable I/O connector. The connector housing 152 may be molded from a dielectric material to include the various features described herein.

As shown in FIGS. 2 and 3, the connector housing 152 defines a receiving cavity 160 that is configured to receive a portion of the mating connector 264. The receiving cavity 160 includes a board-receiving space 162 and a plurality of conductor slots 164, 166 that open to the board-receiving space 162. In the illustrated embodiment, the conductor slots 164, 166 include top conductor slots 164 and bottom conductor slots 166. The top and bottom conductor slots 164, 166 extend lengthwise along the mating axis 196. With reference to FIG. 3, each of the top conductor slots 164 is configured to receive a corresponding portion of a signal conductor 170 or a corresponding portion of a ground conductor 172. Each of the bottom conductor slots 166 is configured to receive a corresponding portion of a signal conductor 174 or a corresponding portion of a ground conductor 176. The signal and ground conductors 170, 172 and the signal and ground conductors 174, 176 of the electrical connector 150 are shown in greater detail in FIG. 4.

The electrical connector 150 also includes resonance-control bridges 180 (shown in FIG. 2) and resonance-control bridges 182 (shown in FIG. 3). The resonance-control bridges 180, 182 may be similar or identical to each other and/or the resonance-control bridges 120 (FIG. 1). The resonance-control bridges 180 are positioned along the top side 154, and the resonance-control bridges 182 are positioned along the mounting side 156. As described herein, each of the resonance-control bridges 180 is configured to electrically couple at least two of the ground conductors 172 (FIG. 3), and each of the resonance-control bridges 182 is configured to electrically couple at least two of the ground conductors 176 (FIG. 3). In some embodiments, the connector housing 152 may include a bridge-receiving recess 184 (shown in FIG. 2) and a bridge-receiving recess 186 (shown in FIG. 3). The bridge-receiving recess 184, 186 are sized and shaped to receive the resonance-control bridges 180, 182, respectively.

Figure 4:
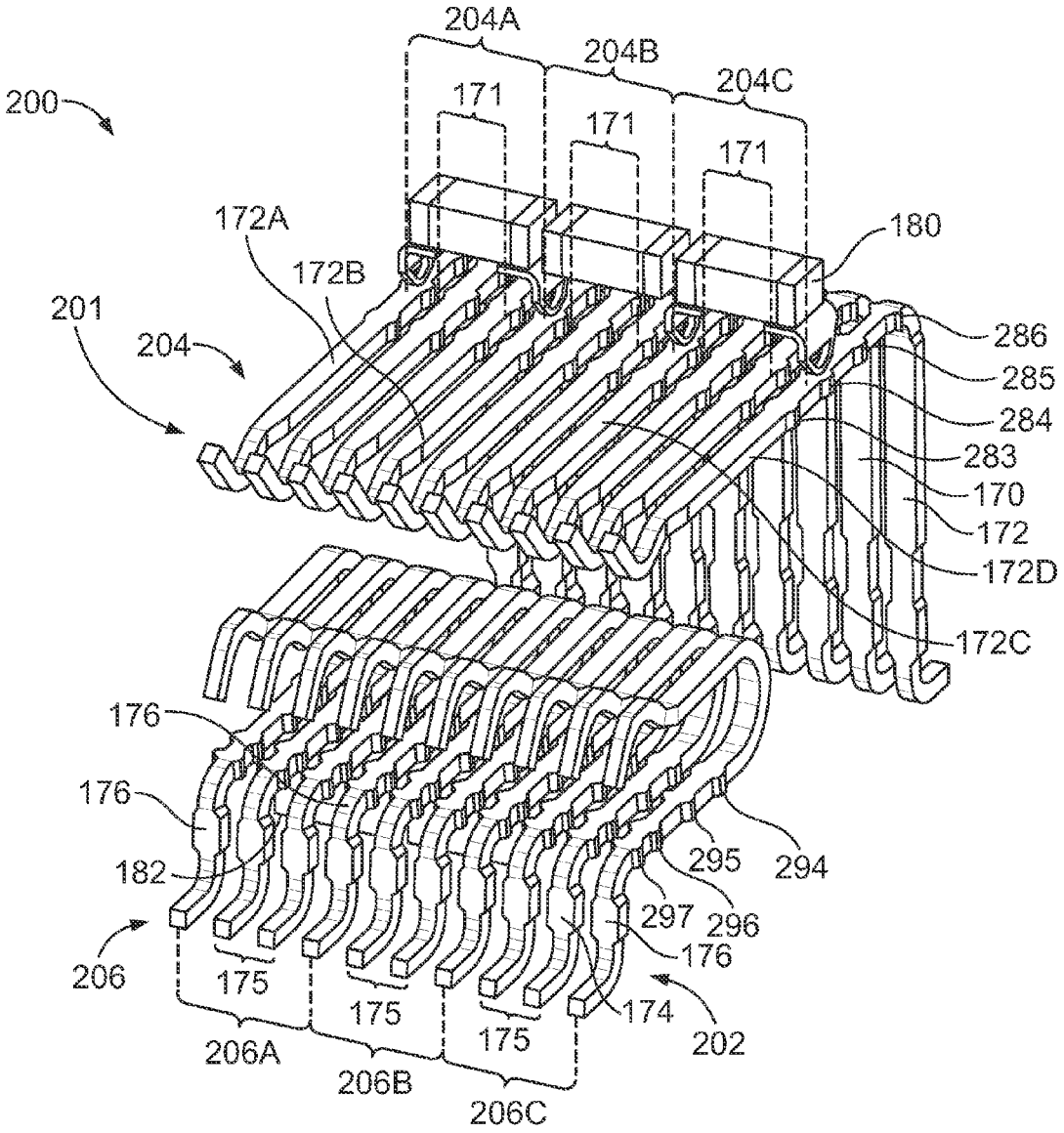
FIG. 4 is a perspective view of a signal-transmission assembly that may be used with the electrical connector of FIG. 2.

FIG. 4 is a perspective view of a signal-transmission assembly 200 that includes the signal and ground conductors 170, 172 and the signal and ground conductors 174, 176 of the electrical connector 150 (FIG. 2). The signal-transmission assembly 200 also includes the resonance-control bridges 180, 182. The signal and ground conductors 170, 172 and the signal and ground conductors 174, 176 are configured to extend between the front side 153 (FIG. 7) and the mounting side 156 (FIG. 2) of the connector housing 152 (FIG. 2). The signal conductors 170 form corresponding signal pairs 171 that are configured to carry differential signals, and the signal conductors 174 form corresponding signal pairs 175 that are configured to carry differential signals. The ground conductors 172 are positioned relative to the signal pairs 171 to electrically separate adjacent signal pairs 171 from each other. Likewise, the ground conductors 176 are positioned relative to the signal pairs 175 to electrically separate adjacent signal pairs 175.

The signal and ground conductors 170, 172 form a first conductor row 201. The signal and ground conductors 170, 172 of the first conductor row 201 may have identical or essentially identical shapes. For example, the signal and ground conductors 170, 172 may be stamped-and-formed from sheet metal using a common press. Likewise, the signal and ground conductors 174, 176 form a second conductor row 202. The signal and ground conductors 174, 176 of the second conductor row 202 may have identical or essentially identical shapes.

The signal conductors (or signal pairs) and the ground conductors are positioned relative to one another to form a plurality of ground-signal-signal-ground (GSSG) sub-arrays. For example, the signal and ground conductors 170, 172 of the first conductor row 201 form three GSSG sub-arrays 204, which are designated as GSSG sub-arrays 204A, 204B, 204C. The signal and ground conductors 174, 176 of the second conductor row 202 form three GSSG sub-arrays 206, which are designated as GSSG sub-arrays 206A, 206B, 206C. Each of the GSSG sub-arrays 204 includes a corresponding signal pair 171 having two ground conductors 172 on opposite sides of the corresponding signal pair 171. Each of the GSSG sub-arrays 206 includes a corresponding signal pair 175 having two ground conductors 176 on opposite sides of the corresponding signal pair 175. It should be understood that the first conductor row 201 may include more than three GSSG sub-arrays 204 and the second conductor row 202 may also include more than three GSSG sub-arrays 204.

In the illustrated embodiment, adjacent GSSG sub-arrays may share a ground conductor. For example, the GSSG sub-array 204A includes a ground conductor 172A and a ground conductor 172B. The GSSG sub-array 204B includes the ground conductors 172B and a ground conductor 172C. The GSSG sub-array 204C includes the ground conductor 172C and a ground conductor 172D. In the GSSG sub-array 204A, the ground conductor 172A may be designated as a first ground conductor and the ground conductor 172B may be designated as a second ground conductor. In the GSSG sub-array 204B, however, the ground conductor 172B may be designated as a first ground conductor and the ground conductor 172C may be designated as the second ground conductor. In such embodiments, the ground conductor 172B may be a shared ground conductor that separates the corresponding signal pairs 171 of the GSSG sub-arrays 204A, 204B. In some embodiments, the shared ground conductor 172B may be coupled to two of the resonance-control bridges 180. As shown in FIG. 4, the ground conductor 172C is also a shared ground conductor that separates the corresponding signal pairs 171 of the GSSG sub-arrays 204B, 204C.

In alternative embodiments, the GSSG sub-arrays 204A-204C may not share a ground conductor. More specifically, each of the GSSG sub-arrays 204A-204C may include two ground conductors without sharing either of the ground conductors. In such embodiments, the pattern of the first conductor row 201 may be ground-signal-signal-ground-ground-signal-signal-ground-ground-signal-signal-ground or (G-S-S-G-G-S-S-G-G-S-S-G).

Also shown in FIG. 4, the signal and ground conductors 170, 172 may include interference features 283, 284, 285, 286, and the signal and ground conductors 174, 176 may include interference features 294, 295, 296, 297. As described below, the interference features 283-286 and 294-297 are configured to engage portions of the connector housing 152 (FIG. 2) to hold the corresponding conductor relative to the connector housing 152.

Figure 5:
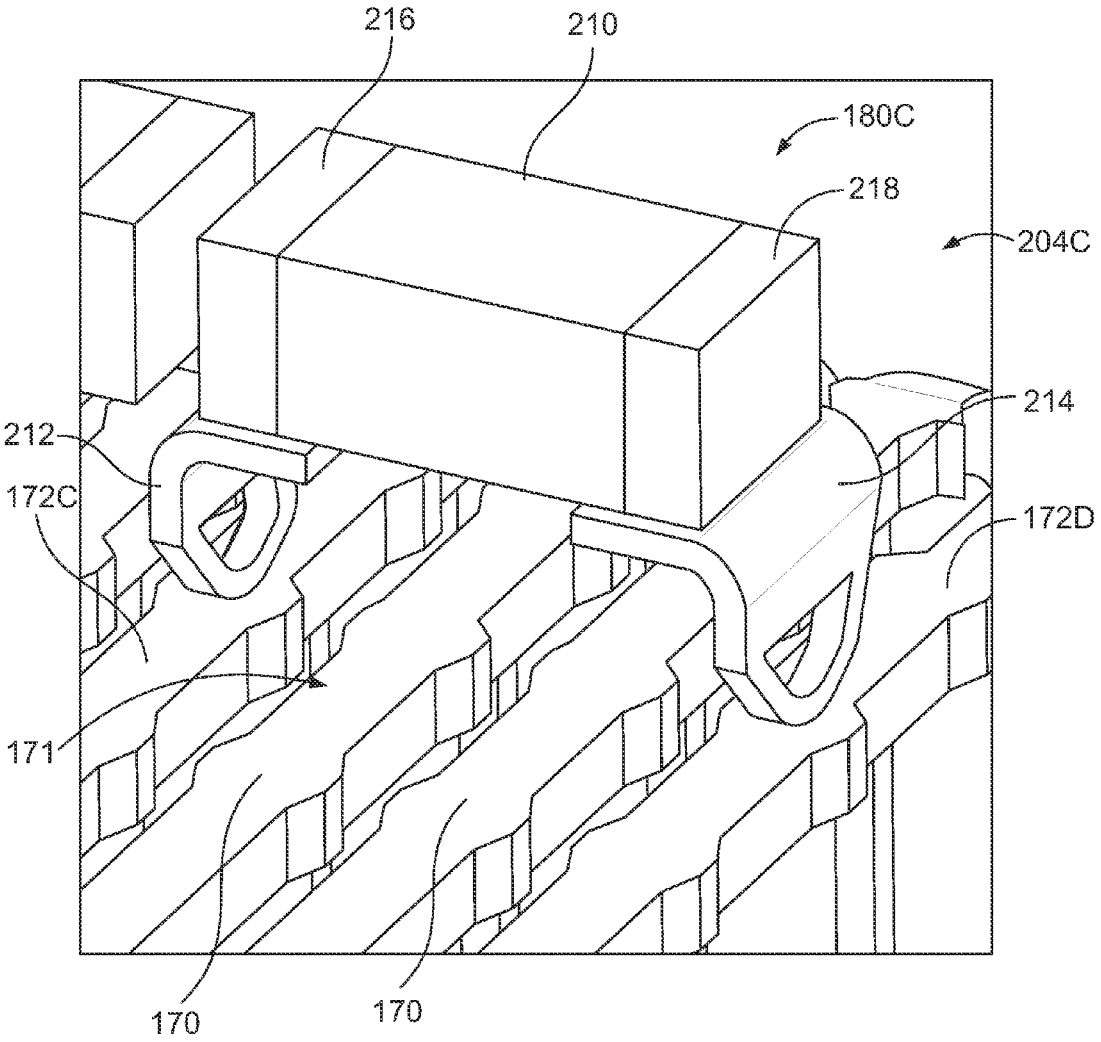
FIG. 5 is an enlarged cutaway view of the signal-transmission assembly of FIG. 4 illustrating a single resonance-control bridge.

FIG. 5 is a perspective view that illustrates a resonance-control bridge 180C in greater detail. The resonance-control bridge 180C is coupled to the first and second ground conductors 172C, 172D of the GSSG sub-array 204C. The first and second ground conductors 172C, 172D flank the corresponding signal pair 171 of the signal conductors 170. The resonance-control bridge 180C includes a discrete component 210. The discrete component 210 may include at least one of a capacitor or resistor. For example, in the illustrated embodiment, the discrete component 210 is a capacitor, such as a multilayer ceramic chip capacitor.

In the illustrated embodiment, the discrete component 210 is substantially box-shaped and extends between opposite first and second terminals 216, 218. The first and second terminals 216, 218 are mechanically and electrically coupled to the first and second interconnecting elements 212, 214, respectively. The interconnecting elements 212, 214 are hereinafter referred to as bridge shoes 212, 214, respectively. The first and second terminals 216, 218 may be soldered or welded to the first and second bridge shoes 212, 214, respectively. The first bridge shoe 212 interconnects the first terminal 216 and the ground conductor 172C. The second bridge shoe 214 interconnects the second terminal 218 and the ground conductor 172D. In the illustrated embodiment, the first bridge shoe is T-shaped, and the second bridge shoe 214 is L-shaped, but other shapes may be used. The other resonance-control bridges 180 and the resonance-control bridges 182 (FIG. 4) may be similar or identical to the resonance-control bridge 180 shown in FIG. 5.

Figure 6:
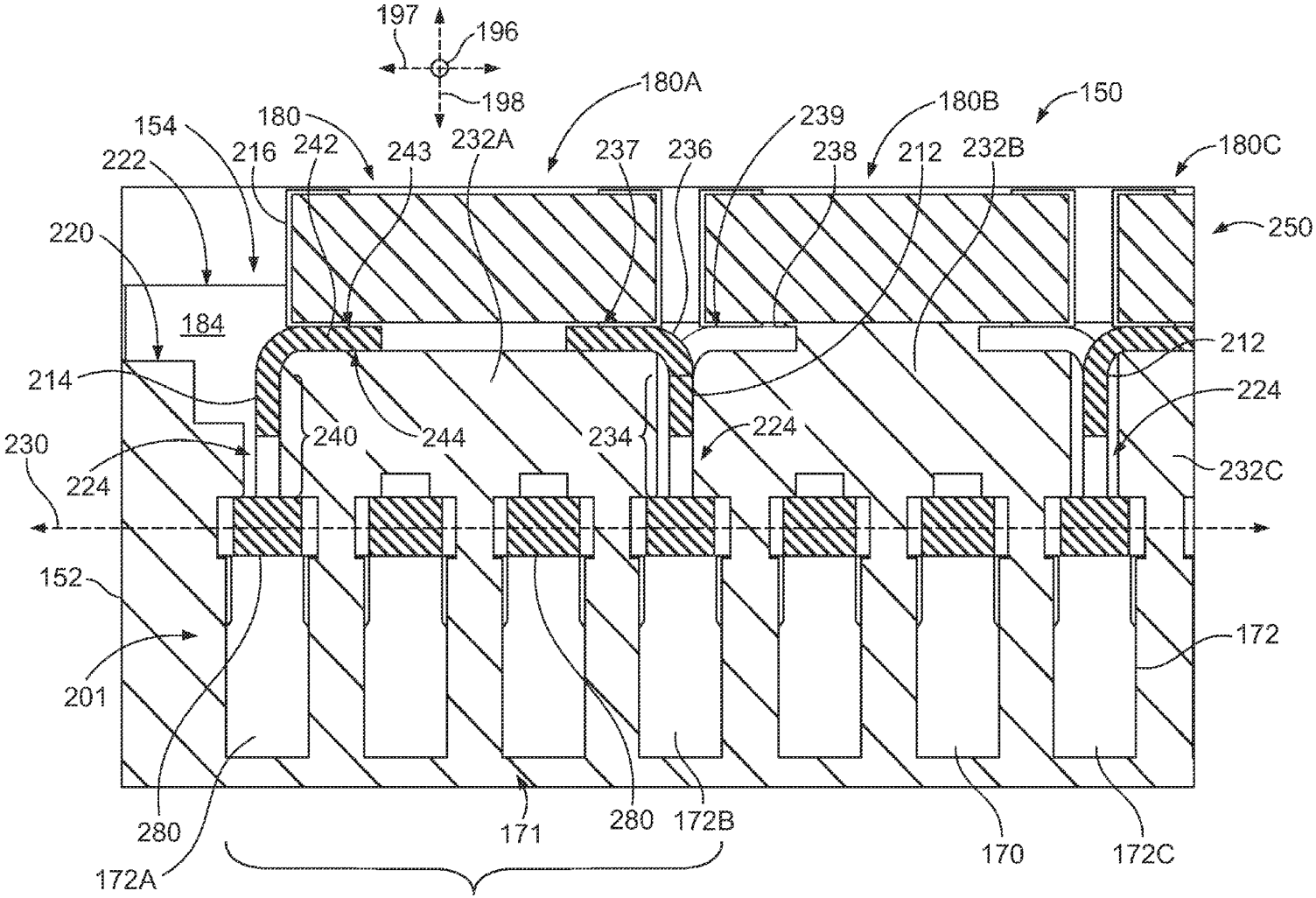
FIG. 6 is an enlarged cross-section of the electrical connector of FIG. 2 illustrating a plurality of the resonance-control bridges interconnecting ground conductors of the electrical connector.

FIG. 6 is an enlarged cross-section of a portion of the electrical connector 150 taken along the line 6-6 in FIG. 2. The connector housing 152 has a receiving surface 220 that defines a portion of the top side 154. More specifically, the receiving surface 220 defines a portion of the bridge-receiving recess 184. The receiving surface 220 is located a depth from a top surface 222 of the top side 154. Each of the receiving and top surfaces 220, 222 faces an exterior of the connector housing 152. Also shown, the connector housing 152 may include coupling cavities 224 that open to the bridge-receiving recess 184 and the exterior of the connector housing 152. In FIG. 6, the coupling cavities 224 extend from the receiving surface 220 toward the corresponding ground conductors 172A, 172B, 172C.

Figure 7:
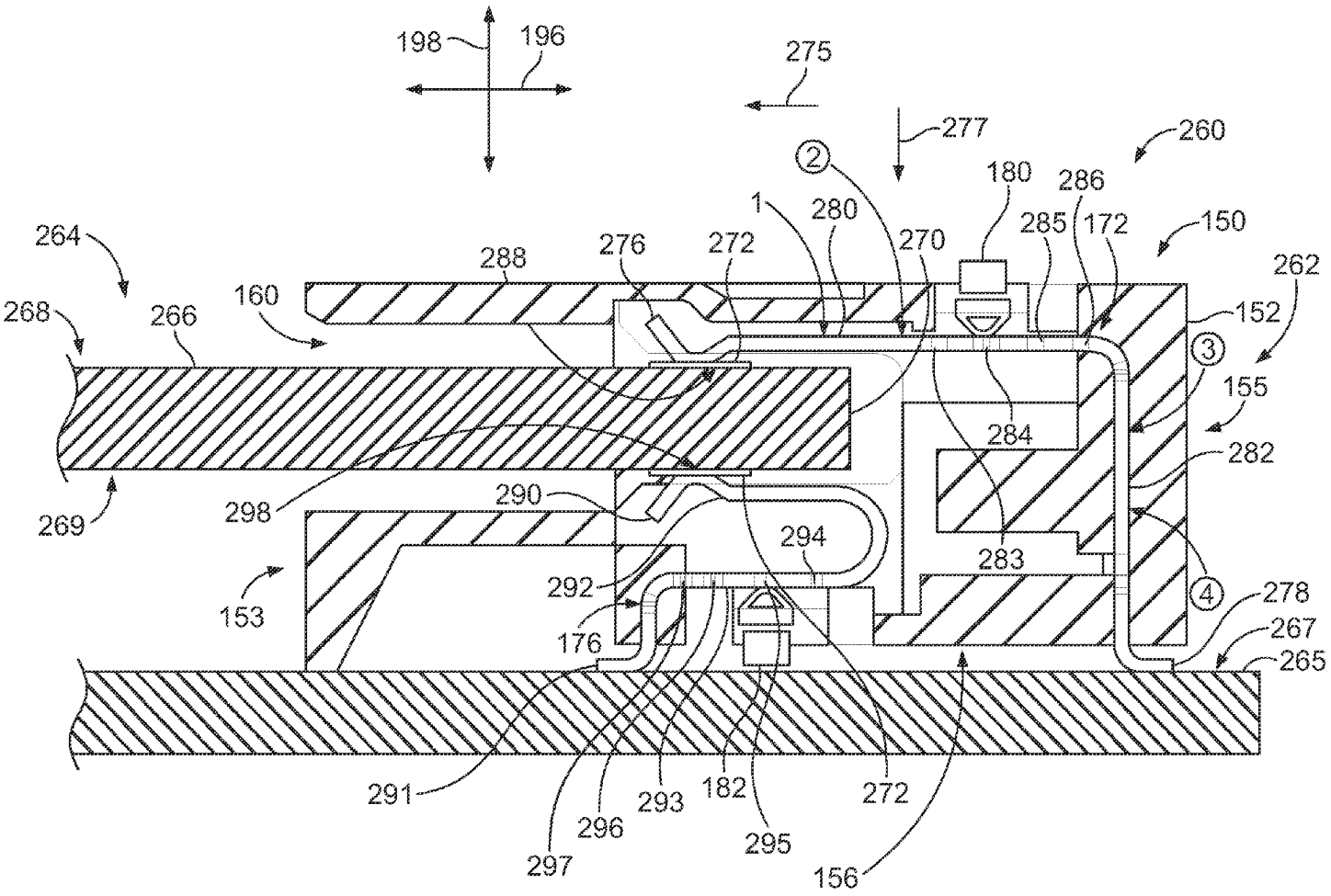
FIG. 7 is a side cross-section of a communication assembly that includes the electrical connector of FIG. 2 and a mating connector.

FIG. 6 illustrates two resonance-control bridges 180A, 180B and a portion of the resonance-control bridge 180C. As shown, the signal conductors 170 and the ground conductors 172 of the first connector row 201 are co-planar. More specifically, flex segments 280 of the signal and ground conductors 170, 172 coincide with a conductor plane 230 that extends parallel to the mating and lateral axes 196, 197. The flex segments 280 are configured to engage the mating connector 264 (FIG. 7). A side view of the flex segments 280 is shown in FIG. 7.

The connector housing 152 includes platform portions 232A, 232B, 232C that are configured to support the resonance-control bridges 180A, 180B, and 180C, respectively. Each of the platform portions 232A-232C is positioned between the corresponding resonance-control bridge and one of the signal pairs 171 and is defined laterally between two of the coupling cavities 224. For example, the platform portion 232A is positioned between the resonance-control bridge 180A and the signal pair 171 of the GSSG sub-array 204A. The platform portion 232A separates the resonance-control bridge 180A from the corresponding signal pair 171. The adjacent platform portions 232A, 232B are separated by one of the coupling cavities 224, and the adjacent platform portions 232B, 232C are separated by another of the coupling cavities 224.

The resonance-control bridge 180A is coupled to the ground conductors 172A, 172B through bridge shoes 214, 212, respectively. The resonance-control bridge 180B is coupled to the ground conductors 172B, 172C through corresponding bridge shoes 212. In the illustrated embodiment, each of the bridge shoes 212 is a shared bridge shoe that electrically couples a shared ground conductor to two of the resonance-control bridges 180. For example, one of the bridge shoes 212 electrically couples the resonance-control bridge 180A and the resonance-control bridge 180B to the shared ground conductor 172B. The other bridge shoe 212 shown in FIG. 6 electrically couples the resonance-control bridge 180B and the resonance-control bridge 180C to the shared ground conductor 172C.

Figure 11:
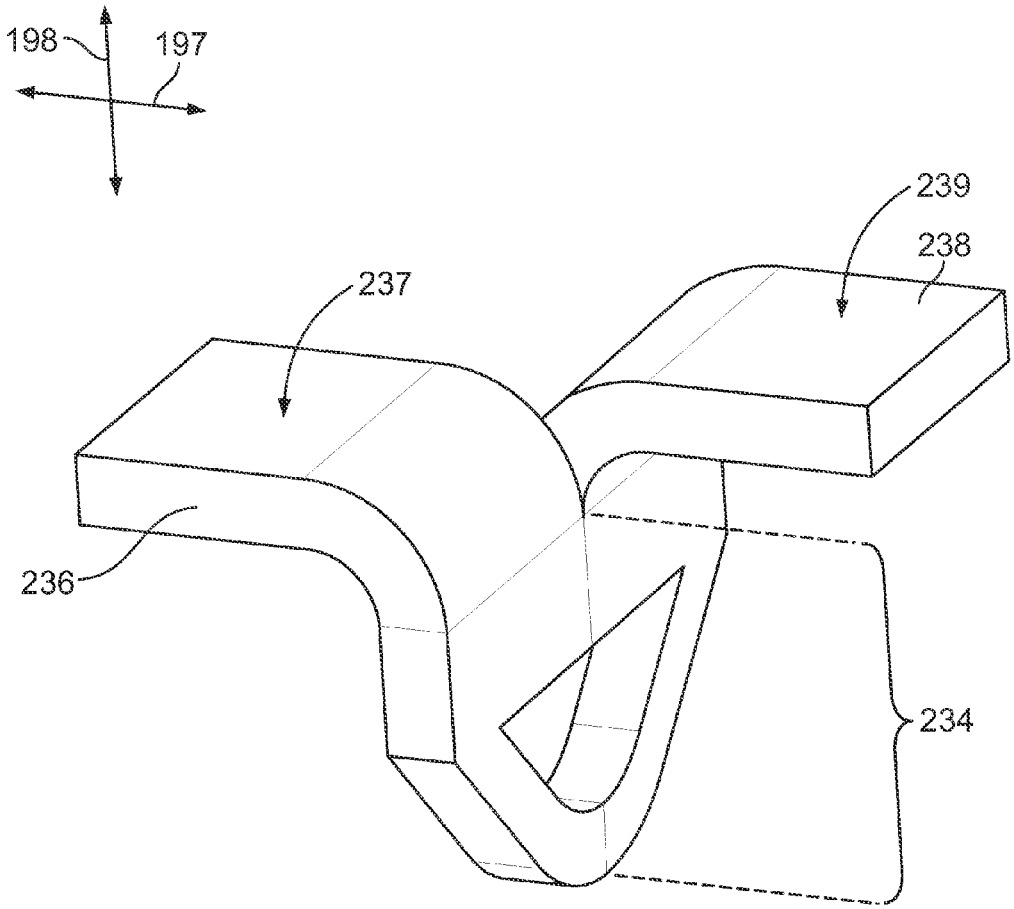
FIG. 11 is an isolated perspective view of an exemplary bridge shoe that may be used with the electrical connector of FIG. 2.

FIG. 11 is an isolated perspective view of an exemplary bridge shoe 212. The bridge shoe 212 includes a base portion 234 and first and second fingers 236, 238 that are directly coupled to the base portion 234. In the illustrated embodiment, the base portion 234 includes a planar body that extends parallel to the vertical axis 198. The first and second fingers 236, 238 are shaped to extend away from each other and parallel to the lateral axis 197. The first and second fingers 236, 238 include respective conductive surfaces 237, 239. In the illustrated embodiment, the bridge shoe 212 is stamped-and-formed from sheet metal. For example, a blank of material may be stamped to form the base portion 234 and another portion that include the first and second fingers 236, 238. The other portion may be split and shaped to form the first and second fingers 236, 238 as shown in FIG. 11.

Returning to FIG. 6, the conductive surfaces 237, 239 of the first and second fingers 236, 238, respectively, may be exposed to the exterior of the connector housing 152 when the conductive surfaces 237, 239 are not coupled to the corresponding resonance-control bridges 180. The resonance-control bridge 180A is mechanically and electrically coupled to the conductive surface 237 of the first finger 236, and the resonance-control bridge 180B is mechanically and electrically coupled to the conductive surface 239 of the second finger 238. The base portion 234 may be mechanically and electrically coupled to the corresponding ground conductor 172B. As such, one of the shared bridge shoes 212 may electrically couple the shared ground conductor 172B to the resonance-control bridges 180A, 180B and electrically couple the resonance-control bridges 180A, 180B to each other. The other shared bridge shoes 212 shown in FIG. 6 may electrically couple the shared ground conductor 172C to the resonance-control bridges 180B, 180C and electrically couple the resonance-control bridges 180B, 180C to each other.

The bridge shoe 214 includes a base portion 240 and a finger 242. The base portion 240 engages the ground conductor 172A. The finger 242 includes a conductive surface 243 that may be exposed along the exterior of the connector housing 152 when the conductive surface 243 is not coupled to the resonance-control bridge 180A. The terminal 216 of the resonance-control bridge 180A is mechanically and electrically coupled to the finger 242 and, more specifically, to the conductive surface 243. As described herein, the terminal 216 may be soldered or welded to the finger 242. In alternative embodiments, the bridge shoe 212 and the resonance-control bridge 180A are not discrete elements. For example, the terminal 216 may be shaped to include a finger and/or base portion that extends toward and engages the ground conductor 172A.

As shown, each of the first and second fingers 236, 238 and the finger 243 extends substantially parallel to the conductor plane 230. Each of the first and second fingers 236, 238 and the finger 243 includes a respective underside 244 that faces the corresponding platform portion. In some embodiments, the underside 244 may interface with the corresponding platform portion such that the underside 244 engages the platform portion or has a nominal gap therebetween.

In the illustrated embodiment, the coupling cavities 224 may enable electrical coupling of the resonance-control bridges 180A-180C to the corresponding ground conductors 172 after the signal-transmission assembly 200 (FIG. 4) is positioned within the connector housing 152. For example, the resonance-control bridges 180A-180C may be soldered or welded to the corresponding bridge shoes to form a resonance-control assembly 250 that includes each of the resonance-control bridges 180A-180C and each of the bridge shoes 212, 214. The resonance-control assembly 250 may then be mounted onto the top side 154 such that the base portions 234, 240 are inserted into the corresponding coupling cavities 224 and engage the corresponding ground conductors 172. In other embodiments, the bridge shoes 212, 214, prior to being attached to the corresponding resonance-control bridges 180A-180C, may be mounted onto the top side 154 such that the base portions 234, 240 are inserted into the corresponding coupling cavities 224 and engage the corresponding ground conductors 172. After the bridge shoes 212, 214 are mounted onto the top side 154, the resonance-control bridges 180A-180C may be soldered or welded to the corresponding bridge shoes as shown in FIG. 6.

In the illustrated embodiment, the resonance-control bridges 180A-180C are positioned along the top side 154 such that the resonance-control bridges 180A-180C are accessible from the exterior of the connector housing 152. Such embodiments may enable easier manufacturing and/or inspection of the electrical connector 150. In alternative embodiments, the bridge shoes 212, 214 and/or the resonance-control bridges 180A-180C are not exposed to the exterior of the connector housing 152. For example, the bridge shoes 212, 214 may be soldered or welded to the corresponding ground conductors 172 prior to the connector housing 152 being molded around the signal-transmission assembly 200 (FIG. 4). In such embodiments, the bridge shoes 212, 214 and/or the resonance-control bridges 180A-

180C may not be viewable and/or accessible to an individual from the exterior of the connector housing 152.

FIG. 7 is a side cross-section of a communication assembly 260 that includes a circuit board assembly 262 and a mating connector 264 that is communicatively coupled to the circuit board assembly 262. The circuit board assembly 262 includes a circuit board 265 having a board surface 267 and the electrical connector 150 mounted to the board surface 267. As shown, the electrical connector 150 is a right-angle connector such that the front side 153 and the mounting side 156 are oriented substantially perpendicular or orthogonal to each other. More specifically, the front side 153 faces in a forward direction 275 along the mating axis 196, and the mounting side 156 faces in a mounting direction 277 along the vertical axis 198.

The receiving cavity 160 is sized and shaped to receive a portion of the mating connector 264. In the illustrated embodiment, the mating connector 264 includes a connector card (or circuit board) 266 that is sized and shaped for inserting into the receiving cavity 160. The mating connector 264 may include other elements, such as a connector housing (not shown) and signal-processing units (not shown) that are mounted to the connector card 266. The connector card 266 includes first and second board surfaces 268, 269 that face in opposite directions and a leading edge 270 that extends between the board surfaces 268, 269. Each of the board surfaces 268, 269 includes a corresponding row of contact pads 272 located along the leading edge 270. The contact pads 272 are configured to engage the signal conductors 170, 174 (FIG. 3) and the ground conductors 172, 176. In FIG. 7, only the ground conductors 172, 176 are shown, but it should be understood that the signal conductors 170, 174 engage corresponding contact pads 272 when the mating connector 264 and the electrical connector 150 are fully mated.

In the illustrated embodiment, each of the ground conductors 172 extends between a distal tip 276 and a terminating end 278. The terminating ends 278 are terminated (e.g., soldered or welded) to corresponding conductive elements of the circuit board 265. Each of the ground conductors 172 includes the flex segment 280 and a base segment 282. The base segment 282 includes the terminating end 278 and the interference features 283, 284, 285, 286. The interference features 283-286 are points or regions along the base segment 282 of the corresponding ground conductor 172 that are shaped to engage the connector housing 152 to hold the base segment 282 in a fixed position relative to the connector housing 152. In the illustrated embodiment, the ground conductor 172 includes four interference features 283-286, but may include fewer or more interference features in other embodiments. The interference features 283-286 and the terminating end 278, which is secured to the circuit board 265, operate to hold the base segment 282 in a fixed position relative to the connector housing 152.

In FIG. 7, the base segment 282 extends from the terminating end 278 to the interference feature 283. The flex segment 280 extends from the interference feature 283 to the distal tip 276. The flex segment 280 may flex when the connector card 266 engages the ground conductors 172 during a mating operation. To this end, the flex segment 280 includes a mating interface 288. The mating interface 288 is shaped to engage the connector card 266 and slide or wipe along the board surface 268 until the mating interface 288 is in a final position engaged to a corresponding contact pad 272 as shown in FIG. 7.

The ground conductors 176 may include similar features as the ground conductors 172. For example, each of the ground conductors 176 extends between a distal tip 290 and a terminating end 291. The terminating ends 291 are terminated (e.g., soldered or welded) to corresponding conductive elements of the circuit board 265. In the illustrated embodiment, the terminating ends 291 are proximate to the front side 153. The terminating ends 278 of the ground conductors 172 are proximate to the back side 155. The terminating ends 276, 278, however, may have different positions in other embodiments.

The ground conductors 176 also include a flex segment 292 and a base segment 293. The base segment 293 includes the terminating end 291 and one or more interference features 294, 295, 296, 297. Like the interference features 283-286, the interference features 294-297 engage the connector housing 152 to hold the base segment 293 in a fixed position relative to the connector housing 152.

In FIG. 7, the base segment 293 extends from the terminating end 291 to the interference feature 294. The flex segment 292 extends from the interference feature 294 to the distal tip 290. The flex segment 292 may flex when the connector card 266 engages the ground conductors 176 during a mating operation. The flex segment 292 also includes a mating interface 298 that is shaped to engage the connector card 266. As shown, the mating interfaces 288, 298 oppose each other and are configured to receive the connector card 266 therebetween.

Each of the ground conductors 172 has an electrical path length that is measured between the mating interface 288 of the corresponding ground conductor 172 and the terminating end 278 of the corresponding ground conductor 172. Each of the ground conductors 176 has an electrical path length that is measured between the mating interface 298 of the corresponding ground conductor 176 and the terminating end 291 of the corresponding ground conductor 176.

The resonance-control bridges 180, 182 are electrically coupled to the ground conductors 172, 176, respectively, at designated locations along the electrical path length. The designated locations are based on a desired electrical performance of the electrical connector 150. For example, in some embodiments, it may be desirable to electrically couple the resonance-control bridge 180 at a path location that is within a middle one-half of the electrical path length of the corresponding ground conductor 172. The middle one-half extends half of the electrical path length between about Point 1 and Point 4 in FIG. 7. In certain embodiments, it may be desirable to electrically couple the resonance-control bridge 180 at a path location that is within a middle one-third of the electrical path length of the corresponding ground conductor 172. The middle one-third extends between Point 2 and Point 3 in FIG. 7. In more particular embodiments, it may be desirable to electrically couple the resonance-control bridge 180 at a path location that is about one-half of the electrical path length of the corresponding ground conductor 172. It is noted that the above examples were described with reference to the resonance-control bridge 180 and the corresponding ground conductor 172. The resonance-control bridge 182 may be coupled to similar path locations of the corresponding ground conductor 176.

In other embodiments, however, the resonance-control bridges 180, 182 may electrically couple to the ground conductors 172, 176, respectively, at other path locations. For example, the resonance-control bridge 180 may electrically couple to the ground conductors 172 at an end-quarter of the corresponding ground conductor 172. The end-quarter represents a quarter of the electrical path length of the corresponding ground conductor 172 that extends between Point 4 and the terminating end 278.

During operation of the communication assembly 260, unwanted electrical energy may propagate between the ground conductors 172, 176. The electrical energy may be repeatedly reflected and form a resonating condition (or standing wave). For example, the electrical energy may be reflected by a ground plane of the circuit board 265 and a ground plane of the connector card 266. Without the resonance-control bridges 180, the electrical energy may resonate at a frequency and magnitude that is based, in part, on the electrical path length between the mating interface 288 and the terminating end 278. Under certain circumstances, the electrical resonance may negatively affect data transmission. When the resonance-control bridges 180 are present, however, the frequency at which the electrical energy resonates may be changed and the magnitude may be reduced. In such embodiments, the negative effects on the electrical resonance may be reduced and, accordingly, signal quality may be improved. As such, the resonance-control bridges 180 may effectively change the frequency at which the electrical energy resonates between the ground conductors 172 such that electrical noise generated by the electrical energy does not significantly degrade signal quality of the data transmission. The resonance-control bridges 182 may have a similar effect as the resonance-control bridges 180.

Figure 9:
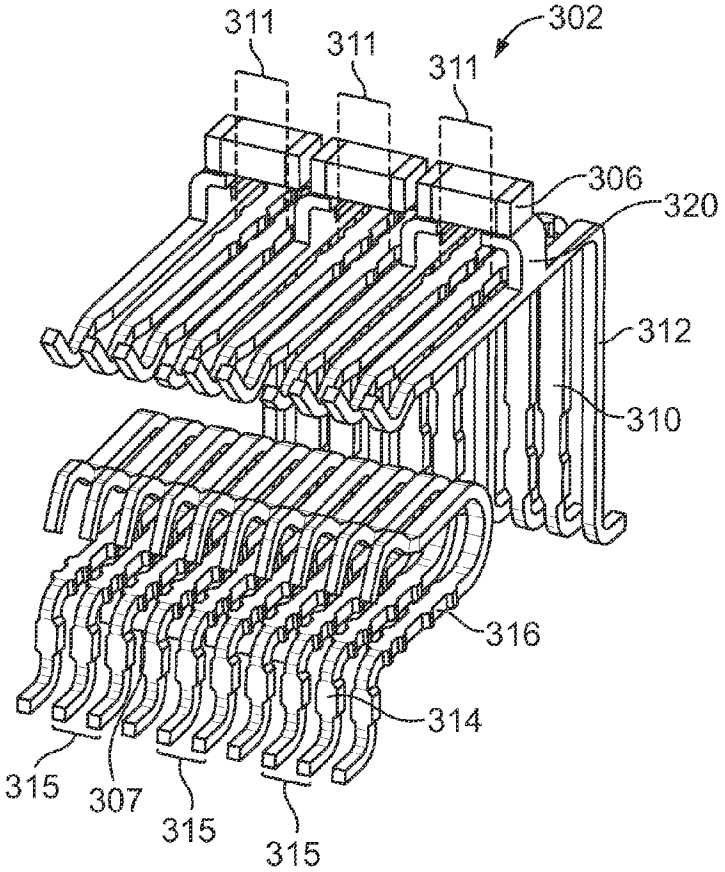
FIG. 9 is a perspective view of a signal-transmission assembly that may be used with the electrical connector of FIG. 8.
Figure 8:
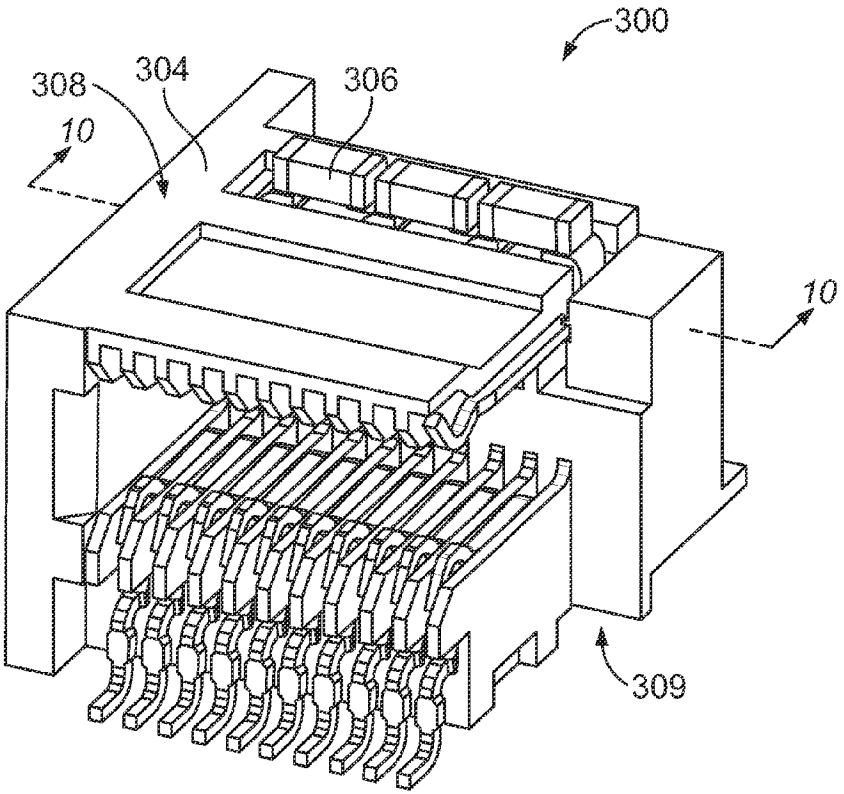
FIG. 8 is a top perspective cutaway view of an electrical connector formed in accordance with an embodiment.

FIG. 8 is a top perspective cutaway view of an electrical connector 300 formed in accordance with an embodiment, and FIG. 9 is a perspective view of a signal-transmission assembly 302 that may be used with the electrical connector 300 of FIG. 8. The electrical connector 300 (FIG. 8) may be similar to the electrical connector 150 (FIG. 2). For example, the electrical connector 300 includes a connector housing 304 that may be similar or identical to the connector housing 152 (FIG. 2). The electrical connector 300 also includes resonance-control bridges 306 that are positioned along a top side 308 of the connector housing 304 and resonance-control bridges 307 (shown in FIG. 9) that are positioned along a mounting side 309 of the connector housing 304.

With respect to FIG. 9, the signal-transmission assembly 302 may be similar to the signal-transmission assembly 200 (FIG. 4). For example, the signal-transmission assembly 302 includes signal and ground conductors 310, 312 and signal and ground conductors 314, 316. The signal-transmission assembly 302 also includes the resonance-control bridges 306, 307. The signal and ground conductors 310, 312 and the signal and ground conductors 314, 316 are configured to extend between the front side (not shown) and the mounting side 309 (FIG. 8) of the connector housing 304 (FIG. 8). The signal conductors 310 form corresponding signal pairs 311 that are configured to carry differential signals, and the signal conductors 314 form corresponding signal pairs 315 that are configured to carry differential signals. The ground conductors 312 are interleaved between the signal pairs 311 to electrically separate adjacent signal pairs 311 from each other. Likewise, the ground conductors 316 are interleaved between the signal pairs 315 to electrically separate adjacent signal pairs 315. In the illustrated embodiment, the ground conductors 312 form interconnecting elements 320 that are configured to mechanically and electrically couple to corresponding resonance-control bridges 306. The interconnecting elements 320 are hereinafter referred to as ground tabs 320.

Figure 10:
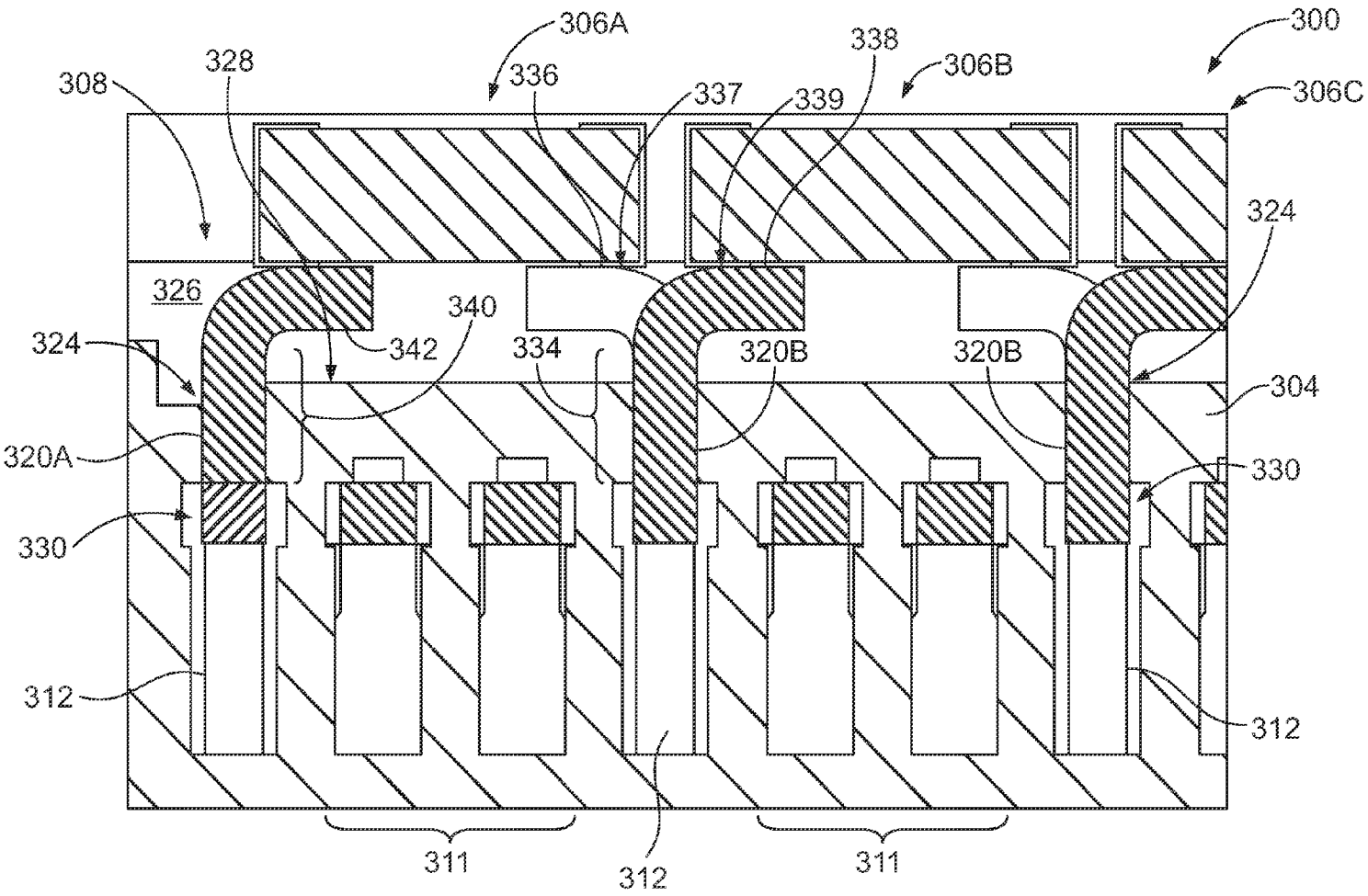
FIG. 10 is an enlarged cross-section of the electrical connector of FIG. 2 illustrating a plurality of the resonance-control bridges interconnecting ground conductors of the electrical connector.

FIG. 10 is an enlarged cross-section of the electrical connector 300 taken along the line 10-10 in FIG. 8 and illustrates resonance-control bridges 306A, 306B and a portion of a resonance-control bridge 306C. The portion of the connector housing 304 shown in FIG. 10 is similar or identical to the portion of the connector housing 152 shown in FIG. 6. For example, the connector housing 304 includes coupling cavities 324 that open to a bridge-receiving recess 326 along the top side 308 and the exterior of the connector housing 304. In the illustrated embodiment, the coupling cavities 324 extend from a receiving surface 328 toward respective ground channels 330. The ground channels 330 have the ground conductors 312 disposed therein.

As shown in FIG. 10, the ground tabs 320 extend through corresponding coupling cavities 324. The ground tabs 320 include a ground tab 320A and ground tabs 320B. The ground tabs 320B are shared ground tabs. For example, each of the ground tabs 320B includes a base portion 334 and first and second fingers 336, 338 that are directly coupled to the base portion 334. The first and second fingers 336, 338 are shaped to extend away from each other and along the top side 308. The first and second fingers 336, 338 include respective conductive surfaces 337, 339 that are positioned within the bridge-receiving recess 326 of the connector housing 304.

As shown, the resonance-control bridge 306A is mechanically and electrically coupled to the conductive surface 337 of the first finger 336, and the resonance-control bridge 306B is mechanically and electrically coupled to the conductive surface 339 of the second finger 338. As such, the ground tab 320B is a shared ground tab that electrically couples each of the resonance-control bridges 306A, 306B to the same ground conductor 312. The ground conductor 312 that includes the ground tab 320B may also be a shared ground conductor that is positioned between two signal pairs 311. The ground tab 320A also includes a base portion 340 and a finger 342. The finger 342 is mechanically and electrically coupled to the resonance-control bridge 306A.

Accordingly, embodiments described herein include interconnecting elements that extend through a housing side, such as a top side, to electrically couple the ground conductors and the resonance-control bridges. Particular examples of interconnecting elements that may be used include the bridge shoes 212, 214 (FIG. 5) and the ground tabs 320 (FIG. 9). It should be understood, however, that other interconnecting elements may extend through a housing side to electrically couple the resonance-control bridges to corresponding ground conductors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector housing having a front side configured to mate with a mating connector and a mounting side configured to be mounted to a circuit board;

signal and ground conductors extending through the connector housing, the signal and ground conductors configured to engage the mating connector and be terminated to the circuit board, the signal conductors forming a plurality of signal pairs configured to carry differential signals, the ground conductors being interleaved between the signal pairs to form a plurality of ground-signal-signal-ground (GSSG) sub-arrays, each GSSG sub-array including a corresponding signal pair and first and second ground conductors that separate the corresponding signal pair from adjacent signal pairs; and a plurality of resonance-control bridges in which each resonance-control bridge of said plurality electrically couples the first and second ground conductors of a corresponding GSSG sub-array, each of the resonance-control bridges including a discrete component that has opposite first and second terminals and at least one of a capacitor or a resistor extending between and joining the first and second terminals, the first and second terminals forming ends of the corresponding discrete components, the first and second ground conductors of the corresponding GSSG sub-arrays being electrically coupled to the first and second terminals, respectively, of the corresponding discrete components.

2. The electrical connector of claim 1, wherein the first and second ground conductors of each GSSG sub-array are electrically coupled to first and second conductive surfaces, respectively, that are exposed along an exterior of the connector housing, the first and second terminals of the corresponding discrete component being directly coupled to the first and second conductive surfaces, respectively, that are electrically coupled to the first and second ground conductors, respectively.

3. The electrical connector of claim 1, wherein the connector housing includes a housing side that faces an exterior of the connector housing, the resonance-control bridges being positioned along the housing side such that the resonance-control bridges are accessible from the exterior of the connector housing.

4. The electrical connector of claim 1, wherein the connector housing includes a housing side having a plurality of coupling cavities that permit access to the first and second ground conductors of the plurality of GSSG sub-arrays, the electrical connector further comprising first and second bridge shoes extending through corresponding coupling cavities, the first and second bridge shoes being directly coupled to the first and second terminals, respectively, of the corresponding discrete component.

5. The electrical connector of claim 1, wherein the connector housing includes a housing side having a plurality of coupling cavities that permit access to the first and second ground conductors of the plurality of GSSG sub-arrays, wherein the first and second ground conductors form ground tabs that extend through corresponding coupling cavities, the first and second terminals of the corresponding discrete component being directly coupled to the ground tabs of the first and second ground conductors, respectively.

6. The electrical connector of claim 1, wherein the first and second ground conductors include a base segment that has a fixed position relative to the connector housing and a flex segment that is permitted to move relative to the connector housing, the flex segment configured to engage corresponding contacts of the mating connector, the resonance-control bridges being coupled to the base segments of the first and second ground conductors.

7. The electrical connector of claim 1, wherein each of the first and second ground conductors has an electrical path length that is measured between a mating interface of the corresponding ground conductor and a terminating end of the corresponding ground conductor, the resonance-control bridges being electrically coupled to the first and second ground conductors within a middle one-half of the corresponding electrical path lengths.

8. The electrical connector of claim 1, wherein the connector housing includes a housing side that forms a bridge-receiving recess, the resonance-control bridges being positioned within the bridge-receiving recess.

9. The electrical connector of claim 1, wherein the electrical connector is capable of transmitting data signals through the signal conductors at greater than 20 gigabits/second.

10. The electrical connector of claim 1, wherein the plurality of GSSG sub-arrays include a first GSSG sub-array and a second GSSG sub-array, the first and second GSSG sub-arrays having a shared ground conductor that is the second ground conductor of the first GSSG sub-array and the first ground conductor of the second GSSG sub-array, the shared ground conductor being coupled to two of the discrete components.

11. The electrical connector of claim 1, wherein the discrete components include discrete capacitors that extend between the first and second terminals.

12. The electrical connector of claim 11, wherein the discrete capacitors include multilayer ceramic chip capacitors.

13. The electrical connector of claim 1, wherein the electrical connector includes corresponding interconnecting elements that electrically couple the first and second terminals of the discrete components to the first and second ground conductors, respectively, the first and second terminals being welded or soldered to the corresponding interconnecting elements.

14. The electrical connector of claim 13, wherein the interconnecting elements are ground tabs of the ground conductors or discrete ground shoes.

15. The electrical connector of claim 1, An electrical connector comprising:

a connector housing having a front side configured to mate with a mating connector and a mounting side configured to be mounted to a circuit board;

signal and ground conductors extending through the connector housing, the signal and ground conductors configured to engage the mating connector and be terminated to the circuit board, the signal conductors forming a plurality of signal pairs configured to carry differential signals, the ground conductors being interleaved between the signal pairs to form a plurality of ground-signal-signal-ground (GSSG) sub-arrays, each GSSG sub-array including a corresponding signal pair and first and second ground conductors that separate the corresponding signal pair from adjacent signal pairs; and a plurality of resonance-control bridges in which each resonance-control bridge of said plurality electrically couples the first and second ground conductors of a corresponding GSSG sub-array, each of the resonance-control bridges including at least one of a capacitor or a resistor;

wherein the plurality of GSSG sub-arrays include a first GSSG sub-array and a second GSSG sub-array, the first and second GSSG sub-arrays having a shared ground conductor that is the second ground conductor of the first GSSG sub-array and the first ground conductor of the second GSSG sub-array, the shared ground conductor being coupled to two of the resonance-control bridges at a common path location of the shared ground conductor.

16. The electrical connector of claim 15, wherein the two resonance-control bridges are coupled to the shared ground conductor through a shared interconnecting element, the shared interconnecting element including a base portion that couples to the shared ground conductor and first and second fingers, the first and second fingers being shaped to extend away from each other.

17. The electrical connector of claim 15, wherein the two resonance-control bridges are coupled to the shared ground conductor through a shared interconnecting element.

18. An electrical connector comprising:

a connector housing having a front side configured to mate with a mating connector and a mounting side configured to be mounted to a circuit board;

signal and ground conductors extending through the connector housing, the signal and ground conductors configured to engage the mating connector and be terminated to the circuit board, the signal conductors forming a plurality of signal pairs configured to carry differential signals, the ground conductors being interleaved between the signal pairs to form a plurality of ground-signal-signal-ground (GSSG) sub-arrays, each GSSG sub-array including a corresponding signal pair and first and second ground conductors that separate the corresponding signal pair from adjacent signal pairs; and a plurality of resonance-control bridges in which each resonance-control bridge of said plurality electrically couples the first and second ground conductors of a corresponding GSSG sub-array, each of the resonance-control bridges including at least one of a capacitor or a resistor;

wherein the connector housing further comprises a housing side and the signal and ground conductors form a first conductor row and a second conductor row, the resonance-control bridges being coupled to the first and second ground conductors of the first conductor row through the housing side, the resonance-control bridges being coupled to the first and second ground conductors of the second conductor row through the mounting side.

19. The electrical connector of claim 18, wherein each of the resonance-control bridges includes a discrete component that has opposite first and second terminals and at least one of a capacitor or a resistor extending between and joining the first and second terminals, the first and second terminals forming ends of the corresponding discrete components, the first and second ground conductors of the corresponding GSSG sub-arrays being electrically coupled to the first and second terminals, respectively, of the corresponding discrete components.

20. The electrical connector of claim 18, wherein the plurality of GSSG sub-arrays include a first GSSG sub-array and a second GSSG sub-array, the first and second GSSG sub-arrays having a shared ground conductor that is the second ground conductor of the first GSSG sub-array and the first ground conductor of the second GSSG sub-array, the shared ground conductor being coupled to two of the resonance-control bridges at a common path location of the shared ground conductor.

* * * * *